United States Patent [19]

Kimura

[11] Patent Number: 4,966,484

[45] Date of Patent: Oct. 30, 1990

[54] TOOL FOR APPLYING HAIR TONIC AND THE LIKE

[75] Inventor: Masaru Kimura, Gunma, Japan

[73] Assignee: Mitsubishi Pencil Co., Ltd., Tokyo, Japan

[21] Appl. No.: 332,387

[22] Filed: Apr. 3, 1989

Related U.S. Application Data

[63] Continuation of Ser. No. 165,314, Mar. 8, 1988, abandoned.

[51] Int. Cl.[5] ..... A46B 11/00; A46B 11/02

[52] U.S. Cl. ..... 401/273; 401/148; 401/291

[58] Field of Search ..... 401/272, 273, 206, 291, 401/148

[56] References Cited

U.S. PATENT DOCUMENTS

| | | | |
|---|---|---|---|
| 738,455 | 9/1903 | King | 401/273 |
| 774,553 | 11/1904 | Boon | 401/273 |
| 893,635 | 7/1908 | Marquart | 401/273 |
| 1,185,760 | 6/1916 | Berry | 401/273 X |
| 1,992,607 | 2/1935 | DeMille | 401/273 |
| 2,493,990 | 1/1950 | Morgadanes et al. | 401/273 |
| 2,793,382 | 5/1957 | Fletcher | 401/272 |

FOREIGN PATENT DOCUMENTS

| | | | |
|---|---|---|---|
| 227332 | 3/1960 | Australia | 401/273 |
| 1016052 | 8/1952 | France | 401/273 |
| 2159698 | 12/1985 | United Kingdom | 401/273 |

*Primary Examiner*—Steven A. Bratlie

*Attorney, Agent, or Firm*—Armstrong, Nikaido, Marmelstein, Kubovcik & Murray

[57] ABSTRACT

A hair tonic coating and patting tool including a hair tonic storage tank, a valve device attached to the storage tank, a top shaft attached to the storage tank, a brush support body which comprises a guide hole communicating with a brush fixing hole, a pole in one side and a support shaft in the opposite side and the support shaft is engaged in the valve rod of the valve device while the brush support body is movable axially and a brush having bristles of slightly larger length than that of the pole.

1 Claim, 1 Drawing Sheet

TOOL FOR APPLYING HAIR TONIC AND THE LIKE

This application is a continuation of application Ser. No. 165,314 filed Mar. 8, 1988 now abandoned.

BACKGROUND OF THE INVENTION

1. Field of the Invention

The present invention relates to a tool for coating hair tonic and, more particularly, relates to a tool for coating hair tonic and patting with which coating of hair tonic and patting of head skin can be operated simultaneously.

2. Prior Art

There is a method for growing hair, known in the prior art, by coating a hair tonic on the skin of hair and softly massages the head skin with fingertips and then patting using a patting brush. With such a method, blood capillaries of the head skin are stimulated, improving the circulation of the blood for smooth supply of nourishment. Thereby, falling of hair is effectively prevented and retarded, together with removing dandruff and surplus skin fat.

According to such a patting hair care method known in the prior art, a hair tonic coating tool and a patting brush must be separately prepared. First, hair tonic is coated and then hair skin is massaged. Therefore, hands are soiled during massaging. To prevent soiling of hands, the hair tonic must be cleaned off before patting with a brush. Work was extremely tedious.

This invention is intended to provide a novel hair tonic coating and patting tool extremely convenient to apply simple patting hair care method, free from such a complication associated with conventional hair care methods.

SUMMARY OF THE INVENTION

The present invention provides a hair tonic coating and patting tool comprising:

A hair tonic storage tank commonly functioning as a main body for coating hair tonic and patting, A valve device attached to the front opening of said storage tank, A cylindrical top shaft attached to the top of the storage tank, A brush support body comprising a plurality of brush fixing holes, guide holes which communicate with said brush fixing holes, a pole of a predetermined length located in one side and a support shaft in the other side, said support shaft being engaged in a valve rod of said valve device, thus said brush support body being movable longitudinally in said cylindrical top shaft, and A brush fixed in the brush fixing holes of said brush support body while bristles of the brush having a length slightly longer than said pole.

DETAILED DESCRIPTION AND THE PREFERRED EMBODIMENT OF THE INVENTION

Figure 1:
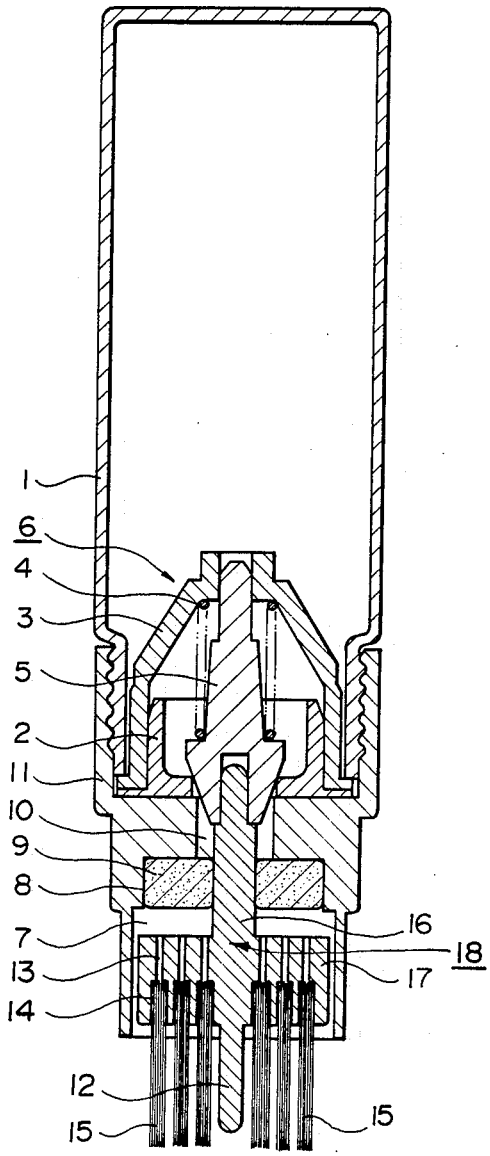
FIG. 1 shows a longitudinal center sectional view of a hair tonic coating and patting tool based on the present invention.

Referring to FIG. 1, a hair tonic storage tank 1 can also function as a main body of coating hair tonic and patting. A valve device 6 is mounted inside of the top end opening of said storage tank 1. Valve device 6 comprises a valve seat 2, a spring seat 3, a valve spring 4 and a valve rod 5.

In the front side of storage tank 1, a cylindrical top shaft 11 is attached by screwing. Top shaft 11 is provided with a cavity portion 7 with a predetermined distance while being opened in the front side. A cutaway step portion 8 is constructed in the rear part. Said cutaway portion 8 is a ring-shape sponge hair tonic storage body 9 is filled. Although this hair tonic storage body is not indispensable, it is preferable to provide this with a view to supplying hair tonic as evenly as possible into the brush.

A brush support body 18 is mounted in the cavity portion 7 of top shaft 11.

Brush support body 18 comprises a base 17, a pole 12 protruded from the center of said base 17 to one side and a support shaft 16 protruded at the center of said base 17 in the direction opposite to said pole 12 in a manner coaxial to said pole 12. On said base 17, there is a brush 15 having bristles of slightly larger length than the length of said pole 12, fixed in brush fixing holes 14 by a method known in the prior art around said pole 12. Behind brush fixing holes 14, there are hair tonic guide holes 13 which communicate with said brush fixing holes 14 and are opened behind base 17.

The support shaft 16 of said base 17 penetrates said sponge hair tonic storage body 9 and engaged in the top opening of a valve rod 5 of the valve device 6. The brush support body 18 is movable longitudinally within the top shaft 11.

Although the pole 12 of base 17 is located at a center portion, the number and mounting position of the pole may also be changed according to particular requirement.

With the foregoing patting and coating tool, the brush 15 is used for patting. The brush 15 is so flexible that, once being pushed onto head skin, it easily deflects. Therefore, pole 12 can come in direct contact with the head skin. With the pole 12 pressed onto the head, the pole 12 is pushed while also pushing the valve rod 5 of valve device 6 inwardly opening the valve device 6. Thus, hair tonic is supplied to cavity portion 7 from the storage tank 1 through a center hole 10 and the sponge hair tonic storage body 9. Thereafter, hair tonic is supplied to the brush and coated onto hair, after passing through the cavity portion 7 and guide holes 13.

When pressure applied to the pole 12 is released, the valve rod 5 returns back in place while closing the valve device 6 and stopping to supply hair tonic.

With the foregoing hair tonic coating and patting tool according to the present invention, patting and hair tonic coating can be operated simultaneously only with a single device and its brush.

What is claimed is:

1. A hair tonic applying and patting tool which comprises:

(a) a hair tonic storage tank which may also function as a main body for the tool;

(b) a valve device secured to the front opening of the storage tank;

(c) a support member projecting into said main body having guide conduit holes opening at a rear surface of said member and brush bristles mounted in said support member at the front and thereof with their rear end in communication with said guide conduit holes and having a spindle slidably received in the front surface of said valve device;

(d) a temporary storage space between said valve device and said guide conduit holes, whereby pushing said bristles against the scalp of a user will cause flow of hair tonic to said bristles and will further open said valve device to allow hair tonic to flow to said temporary storage space;

said support member having a stem, projecting between said bristles to facilitate the patting of the hair tonic into the hair and scalp.

* * * * *